United States Patent [19]

Leuchter et al.

[11] 4,099,193

[45] Jul. 4, 1978

[54] CONTINUOUSLY OPERATING DEVELOPING MACHINE WITH FILMSTRIP TENSION CONTROL

[75] Inventors: Jürgen Leuchter, Tutzing; Gerald Plursch; Johannes Bierinckx, both of Munich, all of Fed. Rep. of Germany

[73] Assignee: AGFA-Gevaert AG, Leverkusen, Fed. Rep. of Germany

[21] Appl. No.: 696,294

[22] Filed: Jun. 15, 1976

[30] Foreign Application Priority Data

Jun. 20, 1975 [DE] Fed. Rep. of Germany ..... 2527559

[51] Int. Cl.[2] ..... G03D 3/13

[52] U.S. Cl. ..... 354/321; 354/319; 226/37; 226/44

[58] Field of Search ..... 354/319, 320, 321, 322, 354/342, 339; 226/37, 38, 44

[56] References Cited

U.S. PATENT DOCUMENTS

| | | | |
|---|---|---|---|
| 1,946,841 | 2/1934 | Ybarrondo | 354/321 |
| 2,727,378 | 12/1955 | Cook | 226/44 |
| 3,501,076 | 3/1970 | Stuart et al. | 226/37 |
| 3,680,803 | 8/1972 | Takata | 354/319 |

FOREIGN PATENT DOCUMENTS

| | | | |
|---|---|---|---|
| 1,962,856 | 8/1972 | Fed. Rep. of Germany | 354/319 |

*Primary Examiner*—L. T. Hix
*Assistant Examiner*—Alan Mathews
*Attorney, Agent, or Firm*—Michael J. Striker

[57] ABSTRACT

The developing machine includes a plurality of processing fluid stages arranged one after the other and a plurality of drying stages arranged one after the other. Film strips are guided along a predetermined winding path through the processing fluid stages and then through the drying stages. A pulling device located downstream of the most downstream one of the drying stations pulls film strips through the developing machine along the predetermined path. A control arrangement controls the operation of the pulling device in dependence upon the tension in film strips being pulled by the pulling device. The control arrangement includes a tension-sensing device operative for sensing the tension in film strips being pulled through the developing machine at a tension-sensing location intermediate the most downstream of the processing fluid stages and the most upstream of the drying stages.

15 Claims, 2 Drawing Figures

TENSION INDICATOR
FILM CASSETTE
FILM ATTACHMENT STATION
FILMSTRIP TAKE-UP DEVICE
PRIME MOVER
INFEED FILM STORAGE
PROCESSING FLUID STAGES
ELECTROMAGNET CLUTCH
FILM PULLING ROLLER
MULTIRATIO TRANSMISSION TURNING FILM DRIVE ROLLERS IN PROCESSING FLUID STAGES 5
DRYING STAGES

CONTINUOUSLY OPERATING DEVELOPING MACHINE WITH FILMSTRIP TENSION CONTROL

BACKGROUND OF THE INVENTION

The invention relates to continuously operating filmstrip developing machines of the type comprised of processing fluid stages and drying stages arranged one after the other, with the filmstrips being guided through the successive stages in a winding path. Typically, the speed of travel of the film is determined by a film-pulling roller.

Considerable progress has been made in recent years in the processing of amateur still photographs, the developing and copying processes employed having been automated to a very great extent. A considerable number of automatically operating processing devices have been devised, such as copying devices, cutting devices, notching devices, developing devices, and the like. It has not in general been possible to automate to a similar extent the developing of exposed amateur still filmstrips, even though it is well known to develop and dry motion-picture film in continuously operating machines. Instead, it has in general continued to be the practice to develop filmstrips received from individual customers in so-called hanger machines employing dipping methods.

In order to be able to develop individual film strips in a continuously performed process, it is necessary to in some manner connect the filmstrips together. In this connection an important problem is the forming of splices which will not come apart in the individual baths of developer, fixer and bleaching fluids and which furthermore are capable of withstanding the mechanical stresses to which they will be subjected in passing through a continuously operating developing machine. When employing a continuous development method, each filmstrip must be guided through from ten to twenty, or even more, processing fluid stages, and then through one or more drying stages. In each of these stages, the filmstrip travels about a plurality of rollers. In order to be able to feed the assemblage of spliced-together filmstrips into film guide arrangements of conventional construction, various proposals have been made relative to the manner in which the film should be fed in order to reduce the stresses leading to film tears.

For example, Federal Republic of Germany Offenlegungsschrift No. 1,962,856 discloses a continuously operating developing machine in which a film-pulling roller is located intermediate the processing fluid stages of the machine, on the one hand, and the drying section of the machine, on the other hand. The film-pulling roller of that machine can be driven at different speeds. This main transport roller (pacer), serving both to determine the filmstrip tension and the speed of film transport, is in conventional machines always arranged between the processing fluid and drying stages of the machine. In this way, the main transport roller additionally serves to compensate for or equalize the differing filmstrip tensions as between the processing fluid stages of the machine, on the one hand, and the drying stages of the machine, on the other hand.

This known arrangement of the film-pulling roller is characterized by a number of disadvantages. When located intermediate the wet-treatment and drying stages of the machine, the pulling roller must have a very large diameter or else slippage of the film strip cannot be reliably enough avoided. Also, means must be provided within the one or more drying stages located downstream of the film-pulling roller for driving the film through the drying part of the developing machine, and these additional means involve further expense. If different photographic materials are to be processed, then it has proved to be necessary to so construct the film-pulling roller as to make it of variable diameter, because changes in filmstrip breadth can result in the development of stresses leading to filmstrip tearing. Additionally, even a small wearing away of the surface of the film-pulling roller, for example to the extent of a few microns, can lead to a loss of correspondence between the pulling force exerted by the roller and the other stresses to which the filmstrip is subjected, resulting in tearing of the filmstrip.

SUMMARY OF THE INVENTION

It is a general object of the invention to provide a continuously operating developing machine of the general type in question so designed that the danger of filmstrip tearing is avoided with simpler means and yet more reliably than was possible in the prior art.

This object, and others which will become more understandable from the description of preferred embodiments, can be met, according to one advantageous concept of the invention, by providing pulling means located downstream of the most downstream one of the drying stages and operative for pulling filmstrips through the developing machine along a predetermined path and control means operative for controlling the operation of the pulling means in dependence upon the tension in filmstrips being pulled by the pulling means, with the control means comprising tension-sensing means operative for sensing the tension in filmstrips being pulled through the developing machine at a tension-sensing location intermediate the most downstream of the processing fluid stages and the most upstream of the drying stages.

In this way, the prime mover for the filmstrip is located at the end of the path of filmstrip travel; accordingly, it is not necessary to provide additional drive means within the one or more drying stages of the machine. The tension-sensing means is arranged at the location at which stress changes are most marked. Stresses developing in the processing fluid or drying stages of the machine are counteracted by controlling the iniation and termination of operation of the film-pulling means. When the film-pulling means is essentially comprised of a film-pulling roller, the diameter of the roller is of only secondary importance. This is because each increase in the tensile stress to which the filmstrip is subjected is sensed by the tension-sensing means and causes an appropriate change in the operation of the film-pulling roller to occur. Additionally, the diameter of the film-pulling roller can be smaller than heretofore, because as a result of the dryness of the film after passing through the one or more drying stages no comparable danger of slippage exists. Matching of the roller diameter to the different speeds of filmstrip transport used in different processing techniques becomes unnecessary.

There are a very large number of factors which can lead to the development of stresses threatening to result in filmstrip tearing. Among these are insufficiently filled processing fluid tanks, film guide or transport rollers which turn with difficulty because of dirtying of or damage to the roller mounts, wearing away of the surface coatings of the passively driven or positively driving guide or transport rollers, improperly installed roller units, etc. All these factors can be detected at their incipiency and be compensated for when the tension-dependent control of the film drive means of the present invention is employed.

When the developing machine is not in operation, the place of a filmstrip to be developed is taken by a leader. When the developing machine is again set into operation, the leader serves to pull the next filmstrip to be developed into and through the machine. Considerable variations in the stress to which the leader is subjected develop due to the fact that filmstrip sections located in the processing fluid stages stretch whereas those located in a drying stage tend to contract back to their original length. These stresses which conventionally lead to the tearing of the filmstrip are detected by the tension-sensing means immediately when they arise, and are compensated for.

In the case of prior-art machines, it was necessary when starting up to gradually increase the speed of operation from zero to full operating speed using special regulating devices. Such regulating devices need not be used according to the present invention, and the developing machine can be set into operation at full speed. This is because the film transport speed is automatically regulated to assume the highest safe value at any given moment due to the action of the tension-sensing and -regulating means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
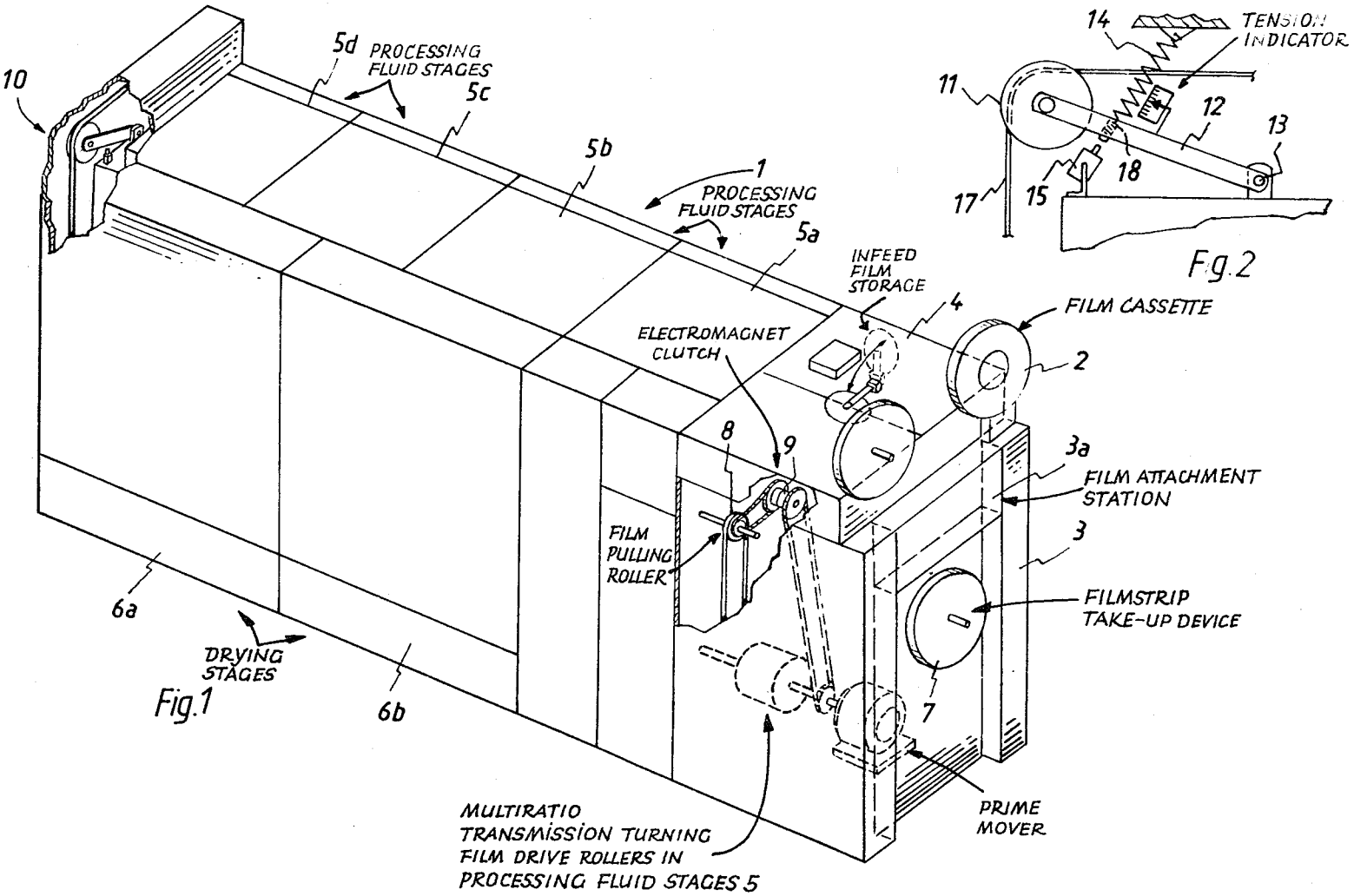
FIG. 1 is a perspective view of a continuously operating developing machine according to the invention.
FIG. 2 is a side view of a tension-sensing arrangement according to the invention.

Numeral 1 generally denotes a continuously operating developing machine, the individual processing sections of which are of U-shaped construction. A closed film cassette 2 is inserted onto an infeed section 3 provided with an infeed film storage 4. The infeed section 3 is furthermore provided with a film attachment station 3*a*. When the developing machine is to be taken out of operation, a leader is connected to the trailing end of the last film strip at the film attachment station 3*a*; likewise, when the developing machine is to be put back into operation, a filmstrip to be developed is connected to the trailing end of the leader at the attachment station 3*a*. The infeed film storage 4 serves to furnish additional time for the attachment of a new filmstrip to be developed to the trailing end of a preceding one or of a leader. The infeed storage 4 accumulates a certain length of filmstrip prior to the entry thereof into the developing stages proper. When the trailing end of a filmstrip leaves the film cassette 2, the operator of the machine can, for example, manually splice the leading end of another filmstrip thereto. During such splicing the trailing end in question is kept at the film attachment station 3a, but the feeding of filmstrip into the developing stages proper need not be interrupted because the filmstrip accumulated in the storage 4 begins to be fed. When the splice is completed, the trailing end of the preceding filmstrip is permitted to enter the infeed storage 4, and during the subsequent feeding of filmstrip into the developing stages proper, the storage 4 accumulates filmstrip anew, in preparation for the next such film attachment operation.

Located downstream of the film infeed storage 4 are four processing fluid stages 5*a*–5*d* each of which consists of four individual processing fluid tanks. Arranged to one side of the four processing fluid stages 5*a*–5*d* are two drying stages 6*a* and 6*b*. Arranged alongside the film infeed storage 4, in the angle between the drying stage 6*b* and the most upstream one 5*a* of the four fluid processing stages 5*a*–5*d*, are additional processing devices, such as for example dosing arrangements for processing fluid regenerators, electrical control devices or means for driving components of the machine and winding up the developed filmstrips.

Arranged intermediate the more downstream drying stage 6*b* and the wind-up arrangement 7 is a film-pulling roller 8. Roller 8 is coupled to the prime mover of the developing machine through the intermediary of an electromagnetic coupling 9.

Arranged intermediate the most downstream processing fluid stage 5*d* and the most upstream drying stage 6*a* is a tension-sensing arrangement 10. Tension-sensing arrangement 10 is depicted in greater detail in FIG. 2. A tension-sensing roller 11 is rotatably mounted on one end of a tension-sensing lever 12 the other end of which is pivotably mounted on a support 13 stationary on the developing machine. The end of lever 12 carrying the roller 11 is connected to one end of a tension spring 14 the other end of which is connected to a stationary portion of the developing machine. A filmstrip 17 is guided over the roller 11. As the tension in the filmstrip 17 increases lever 12 turns counterclockwise against the force of biasing spring 14. Located in the path of movement of lever 12 is a microswitch 15 which becomes activated when the lever 12 assumes an angular position corresponding to a predetermined filmstrip tension value. Lever 12 is provided with an adjusting screw 18. By changing the setting of adjusting screw 18, the microswitch 15 can be caused to become activated at different angular positions of lever 12, and accordingly in response to different filmstrip tension values, as desired.

The operation of the illustrated embodiment is as follows:

The filmstrip inserted into cassette 2 is spliced at the film attachment station 3a, prior to entry into the infeed film storage 4, to the trailing end of a leader which has already been fed through the developing machine 1. Thereupon the prime mover for the developing machine can be set into operation, with the (non-illustrated) filmstrip drive or transport rollers in the interiors of the processing fluid stages 5*a*–5*d* and likewise the film-pulling roller 8 being permitted to reach full speed as soon as they can.

When the prime mover of the machine 1 is first turned on, the sensing lever 12 will be in non-activating position, so that microswitch 15 will be unactivated and so that coupling 9 will establish engagement between the film-pulling roller 8 and the prime mover of the machine. The filmstrip will not be able to follow the sudden tug exerted by the film-pulling roller 8 — mainly because of the inertia inherent in the film transporting means in the processing fluid stages 5a–5d — and as a result the tension in the film-strip at the sensing location will rise to such a value as to cause tension-sensing lever 12 to activate microswitch 15. This causes clutch 9 to disengage, so that film-pulling roller 8 ceases to pull. The tension in the film strip now becomes relieved as a result of the slight continued travel of the portion of the filmstrip in the processing fluid stages 5a–5d of the machine; when the tension is thusly relieved, the sensing arrangement 10 returns to its starting position, thereby deactivating microswitch 15, and causing the film-pulling roller 8 to pull anew. The latter again pulls too quickly, and the series of events just described repeats itself. This automatic turning on and off of the film-pulling roller 8 in effect causes the filmstrip transport speed to be regulated automatically until the desired transport speed is reached. This desired speed will be reached before the leading end of a newly introduced filmstrip reaches the first processing fluid stage.

When the trailing end of the filmstrip to be developed, or the last of a series of filmstrip to be developed, is to be fed into the machine the leading end of a leader will first be spliced thereto. Accordingly, when the leader emerges at the output end of the machine, the developed filmstrip spliced thereto will be removed and taken up on the filmstrip take-up reel. The developing operation is finished.

It may happen that during the course of the developing operation, for one of the reasons discussed in the introductory portion of this specification, a malfunction will arise somewhere in the processing fluid stages of the machine. This malfunction makes itself felt in the form of a tension increase of the filmstrip which, in turn, causes the tension-sensing roller 11 and lever 12 to activate the microswitch 15. Activation of the microswitch can serve, in addition to terminating operation of film-pulling roller 8, to initiate operation of a warning device, for example to alert the operator of the machine. The spring 14 can be so selected that very short-lasting tension surges are taken up by the inherent yieldability of the tension-sensing arrangement without causing activation of microswitch 15. Advantageously, the lever 12 is provided with a pointer cooperating with a calibrated scale making it possible to directly read off the filmstrip tension. This makes it possible to be forwarned of arising problems which are not yet capable of resulting in a film tear but which are on the increase, for example the accumulation of dirt in a rack.

According to one advantageous concept of the invention, if the operator of the machine chooses to shut the machine off, the prime mover of the machine does not immediately shut off, but instead shuts off only after the elapse of a predetermined time delay following the disengagement of electromagnetic coupling 9. The introduction of this time delay makes it possible for film to continue to be transported out of the wet section of the developing machine even after the filmstrip ceases to be pulled, i.e., so that the filmstrip tension inside the dry section of the machine becomes relieved. For example, the driving rollers within the processing fluid stages of the machine, coupled to the prime mover via a transmission, would continue to turn and transport the portion of the filmstrip within the wet portion of the machine until the prime mover itself is shut off.

According to another advantageous concept of the invention, the film transport or drive rollers located within the processing fluid stages 5a–5d are coupled to the prime mover of the machine 1 through the intermediary of a multi-ratio regulating transmission forming part of a servo system. With that set-up, the film-pulling roller 8 can be coupled to the prime mover for constant-speed operation. When the filmstrip tension is within acceptable limits, the multi-ratio transmission will cause the prime mover to turn the filmstrip drive rollers in the processing fluid stages 5a–5d at a speed (expressed for example in meters/min. of filmstrip transport) which exceeds the speed of pulling roller 8 by a preselected normal amount. However, if the filmstrip tension, as detected by sensing means 10, should increase to the point where microswitch 15 becomes activated, switch 15 via a connection to the regulating transmission would automatically change the transmission ratio so as to further increase the speed of the drive rollers in the stages 5a–5d relative to the speed of the pulling roller 8. The effect of this is to temporarily eliminate filmstrip tension. The multiratio transmission can be of any conventional design. At its simplest it could be a two-speed transmission, operative for turning the drive rollers with a first or normal transmission ratio under conditions of normal filmstrip tension and operative for turning the drive rollers with a different transmission ratio under conditions of excessive filmstrip tension. Alternatively, the transmission could be a three- or more -speed transmission, with the transmission ratio automatically changing from one to the next value until such time as the microswitch 15 becomes deactivated. Finally, use could in principle be made of a more complicated transmission having a continuously variable transmission ratio, with the ratio automatically and continuously changing until the film-tension switch 15 becomes deactivated. Advantageously, this operation is indicated by the generation of a warning signal, giving the operator of the machine an opportunity to eliminate the filmstrip transport malfunction without having to interrupt the ongoing developing processes, or giving him the opportunity to cut off a filmstrip section entering the machine and attach in its place a leader, in order to get all filmstrip to be developed out of the fluid stages 5a–5d of the machine as soon as possible so that they will not be caught there and damaged.

The aforedescribed exemplary embodiment is adapted for processing a plurality of filmstrips which have been spliced together to form a very long strip. However, the type of developing machine in question could also be used to develop motion-picture film, since film tears resulting from the causes discussed above can occur with motion-picture film as well.

It is to be noted that the exact number of processing fluid stages 5 and drying stages 6 is not critical for the broadest aspects of the invention. Thus, where reference is made to the most downstream one of the plurality of processing fluid stages or to the most upstream one of the drying stages, it is to be understood that, if only one processing fluid stage or only one drying stage is present then it is that single processing fluid stage or that single drying stage to which reference is being made.

It will be understood that each of the elements described above, or two or more together, may also find a useful application in other types of constructions differing from the types described above.

While the invention has been illustrated and described as embodied in a particular type of developing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a continuously operating developing machine of the type comprised of at least one processing fluid stage and at least one drying stage arranged one after the other and means guiding filmstrips along a predetermined winding path through the processing fluid stages and then through the drying stages, in combination, pulling means located downstream of the most downstream drying stage and operative for pulling filmstrips through the developing machine along the predetermined path, and control means operative for controlling the operation of the pulling means in dependence upon the tension in filmstrips being pulled by the pulling means, the control means comprising tension-sensing means operative for sensing the tension in filmstrips being pulled through the developing machine at a tension-sensing location intermediate the most downstream processing fluid stage and the most upstream drying stage.

2. The developing machine of claim 1, the tension-sensing means comprising a tension-sensing roller and means positioning the tension-sensing roller at said tension-sensing location and mounting the tension-sensing roller for engagement with and displacement by a filmstrip being pulled through the developing machine as a function of the tension in such filmstrip at said tension-sensing location.

3. The developing machine of claim 1, the pulling means comprising a film-pulling roller, a prime mover and a controllable clutch coupling the former to the latter, the control means further including means for controlling the engagement of the clutch in dependence upon the tension sensed by the tension-sensing means.

4. The developing machine of claim 1, the tension-sensing means including means for indicating the filmstrip tension value.

5. The developing machine of claim 1, the control means further including means for generating a warning signal when the tension sensed by the tension-sensing means reaches a predetermined value.

6. The developing machine of claim 1, the control means comprising means for terminating pulling by the pulling means when the tension value sensed by the tension-sensing means reaches a predetermined value.

7. The developing machine of claim 6, the control means further including adjusting means for changing the predetermined value.

8. The developing machine of claim 1, the tension-sensing means comprising a tension-sensing element and spring-biased mounting means mounting the tension-sensing element for contact with the filmstrip and for yielding displacement of said element by said filmstrip at said tension-sensing location.

9. The developing machine of claim 8, the pulling means comprising a film-pulling roller, a prime mover and a controllable electrically operated clutch coupling the former to the latter, the switch device comprising a microswitch located to become activated and disengage the electrically operated clutch when the sensing element assumes a position corresponding to a predetermined filmstrip tension value.

10. The developing machine of claim 1, the tension-sensing means comprising tension-responsive means physically contacting the filmstrip at said tension-sensing location and operative for assuming a plurality of distinguishable states each correlatable with a single respective value of filmstrip tension.

11. In a continuously operating developing machine of the type comprised of at least one processing fluid stage and at least one drying stage arranged one after the other and means guiding filmstrips along a predetermined winding path through the processing fluid stages and then through the drying stages, in combination, drive rollers at the processing fluid stages for driving filmstrips along the predetermined path through the processing fluid stages, pulling means located downstream of the most downstream drying stage and operative for pulling filmstrips through the developing machine along the predetermined path, and control means operative for keeping the speed at which the drive rollers drive filmstrips through the processing fluid stages higher than the speed at which the pulling roller pulls filmstrips through the drying stages by an amount dependent upon filmstrip tension by varying the speed of the drive rollers in dependence upon filmstrip tension, the control means comprising tension-sensing means operative for sensing the tension in filmstrips travelling through the developing machine at a tension-sensing location intermediate the most downstream processing fluid stage and the most upstream drying stage.

12. The developing machine of claim 11, the pulling means comprising a film-pulling roller and a prime mover, the control means including an adjustable-transmission-ratio transmission coupling the drive rollers to the prime mover and means for automatically varying the transmission ratio of the transmission as a function of the tension sensed by the tension-sensing means.

13. A method of controlling the transport of filmstrips through a continuously operating developing machine of the type comprised of at least one processing fluid stage and at least one drying stage arranged one after the other and means guiding filmstrips along a predetermined winding path through the processing fluid stages and then through the drying stages, the method comprising the steps of pulling filmstrips through the developing machine by exerting upon the filmstrips a pulling force at a pulling location downstream of the most downstream one of the drying stages, sensing the filmstrip tension at a tension-sensing location intermediate the most downstream processing fluid stage and the most upstream drying stage, and varying the pulling force exerted at the pulling location as a predetermined function of the tension sensed at the tension-sensing location.

14. In a continuously operating developing machine of the type comprised of at least one processing fluid stage and at least one drying stage arranged one after the other and means guiding filmstrips along a predetermined winding path through the processing fluid stages and then through the drying stages, in combination, pulling means located downstream of the most downstream drying stage and operative for pulling filmstrips through the developing machine along the predetermined path, and control means operative for controlling the operation of the pulling means in dependence upon the tension in filmstrips being pulled by the pulling means, the control means comprising tension-sensing means operative for sensing the tension in filmstrips being pulled through the developing machine at a tension-sensing location intermediate the most downstream processing fluid stage and the most upstream drying stage, the tension-sensing means comprising a sensing lever mounted for pivoting movement, biasing means for urging the sensing lever in one direction, and a sensing roller located at said sensing location and mounted on the sensing lever for engagement with and displacement by a filmstrip in the opposite direction to an extent dependent upon the tension in such filmstrip at such location, the control means further including a switch device connected to the pulling means for controlling operation of the same and positioned to be activated when the sensing lever is displaced to a position corresponding to a predetermined filmstrip tension value.

15. In a continuously operating developing machine of the type comprised of at least one processing fluid stage and at least one drying stage arranged one after the other and means guiding filmstrips along a predetermined winding path through the processing fluid stages and then through the drying stages, in combination, pulling means located downstream of the most downstream drying stage and operative for pulling filmstrips through the developing machine along the predetermined path, and control means operative for controlling the operation of the pulling means in dependence upon the tension in filmstrips being pulled by the pulling means, the control means comprising tension-sensing means operative for sensing the tension in filmstrips being pulled through the developing machine at a tension-sensing location intermediate the most downstream processing fluid stage and the most upstream drying stage, the pulling means comprising a film-pulling device, a prime mover and a controllable clutch coupling the former to the latter, the control means further including means operative in response to the sensing of a predetermined filmstrip tension value for automatically disengaging the controllable clutch and thereafter upon the elapse of a predetermined time delay also shutting off the prime mover.

* * * * *